US010309000B2

(12) United States Patent
Zhao et al.

(10) Patent No.: US 10,309,000 B2
(45) Date of Patent: Jun. 4, 2019

(54) METHOD FOR PREPARING ALUMINUM-COPPER-IRON QUASICRYSTAL AND SILICON CARBIDE MIXED REINFORCED ALUMINUM MATRIX COMPOSITE

(71) Applicant: NORTH UNIVERSITY OF CHINA, Taiyuan (CN)

(72) Inventors: Yuhong Zhao, Taiyuan (CN); Fenghao Zhang, Taiyuan (CN); Hua Hou, Taiyuan (CN); Jinzhong Tian, Taiyuan (CN); Ling Yang, Taiyuan (CN); Yuchun Jin, Taiyuan (CN)

(73) Assignee: NORTH UNIVERSITY OF CHINA, Taiyuan (CN)

( * ) Notice: Subject to any disclaimer, the term of this patent is extended or adjusted under 35 U.S.C. 154(b) by 463 days.

(21) Appl. No.: 15/159,113

(22) Filed: May 19, 2016

(65) Prior Publication Data

US 2016/0355913 A1 Dec. 8, 2016

(30) Foreign Application Priority Data

Jun. 2, 2015 (CN) ..... 2015 1 0296735

(51) Int. Cl.
*C22F 1/04* (2006.01)
*B22C 9/02* (2006.01)
(Continued)

(52) U.S. Cl.
CPC ..... *C22F 1/04* (2013.01); *B22C 3/00* (2013.01); *B22D 21/007* (2013.01); *C22C 1/002* (2013.01);
(Continued)

(58) Field of Classification Search
CPC .... B22D 21/007; C22C 1/026; C22C 32/0063
See application file for complete search history.

(56) References Cited

PUBLICATIONS

Mordyuk, B.n., et al. "Wear Assessment of Composite Surface Layers in Al—6Mg Alloy Reinforced with AlCuFe Quasicrystalline Particles: Effects of Particle Size, Microstructure and Hardness." Wear, vol. 319, No. 1-2, Jul. 24, 2014, pp. 84-95. (Year: 2014).*

* cited by examiner

*Primary Examiner* — Colleen P Dunn
*Assistant Examiner* — Jeremy C Jones
(74) *Attorney, Agent, or Firm* — Global IP Counselors, LLP

(57) ABSTRACT

The present invention relates to a method for preparing an aluminum-copper-iron quasicrystal and silicon carbide mixed reinforced aluminum matrix composite, where the aluminum-copper-iron quasicrystal and silicon carbide mixed reinforced aluminum matrix composite is prepared with an aluminum alloy serving as a matrix and with aluminum-copper-iron quasicrystal and silicon carbide serving as reinforcement agents via smelting in an intermediate-frequency induction melting furnace through the process of intermediate-frequency induction heating, vacuumizing, bottom blowing argon, and casting molding in view of low hardness and low tensile strength of aluminum matrix materials. The prepared aluminum-copper-iron quasicrystal and silicon carbide mixed reinforced aluminum matrix composite has a hardness of 80.3 HB which is improved by 50.64% and tensile strength of 285 Mpa which is improved by 60.42%, and corrosion resistance thereof is improved by 40%.

3 Claims, 2 Drawing Sheets

(51) Int. Cl.

| | |
|---|---|
| ***B22D 21/00*** | (2006.01) |
| ***B22F 9/04*** | (2006.01) |
| ***C22C 1/02*** | (2006.01) |
| ***C22C 1/06*** | (2006.01) |
| ***G01N 3/08*** | (2006.01) |
| ***G01N 3/40*** | (2006.01) |
| ***B22C 3/00*** | (2006.01) |
| ***C22C 1/10*** | (2006.01) |
| ***C22C 32/00*** | (2006.01) |
| ***C22C 1/00*** | (2006.01) |
| ***C22C 45/08*** | (2006.01) |

(52) U.S. Cl.

CPC ..... *C22C 1/026* (2013.01); *C22C 1/06* (2013.01); *C22C 1/101* (2013.01); *C22C 32/0063* (2013.01); *C22C 45/08* (2013.01); *B22F 2998/10* (2013.01)

METHOD FOR PREPARING ALUMINUM-COPPER-IRON QUASICRYSTAL AND SILICON CARBIDE MIXED REINFORCED ALUMINUM MATRIX COMPOSITE

CROSS-REFERENCE TO RELATED APPLICATION

The application claims priority to Chinese Application No. 201510296735.8, filed on Jun. 2, 2015, the contents of which are hereby incorporated herein by reference.

BACKGROUND

Field of Invention

The present invention relates to a method for preparing an aluminum-copper-iron quasicrystal and silicon carbide mixed reinforced aluminum matrix composite, which belongs to a technical field of preparation and use of non-ferrous metal materials.

Background of the Invention

Since aluminum alloys being a non-ferrous metal alloy have good intensity, toughness and electrically and thermally conductive performances, they are usually used as structural materials and are widely used in the fields of aerospace, electronic industry, and automobile manufacturing. However, aluminum alloys have low hardness, low tensile strength and poor corrosion resistance, so that there is a large limit to aluminum alloys in industrial application.

Since quasicrystal materials have the disadvantages of brittleness and loose microstructure, it is very difficult to use quasicrystal materials as structural materials. However, quasicrystals have overall performances of high hardness, non-stickiness, low expansivity, wear-resistance, heat resistance, corrosion resistance and low friction coefficient, so that they can be used as a reinforcement phase in composites to improve mechanical properties of the composites.

Since silicon carbide has the advantages of low price, high wear-resistance and direct casting forming and has low manufacturing cost, it can be used as structural parts and wear-resistant parts in the automobile, aerospace and military industries.

Currently, it is in research phase that aluminum matrix composites are prepared using the mixture of aluminum-copper-iron quasicrystal and silicon carbide as a reinforcement phase, therefore, preparing technology also need to be improved.

SUMMARY

Invention Object

For the case of background art, the object of the present invention is to provide a method for preparing an aluminum-copper-iron quasicrystal and silicon carbide mixed reinforced aluminum matrix composite with an aluminum alloy as a matrix and with aluminum-copper-iron quasicrystal and silicon carbide as reinforcement agents via smelting in a vacuum melting furnace, casting and heat treatment, thereby improving mechanical properties of the aluminum matrix composite and extending its application range.

Technical Solution

Chemical materials used in the invention are aluminum alloy, aluminum-copper-iron quasicrystal, silicon carbide, zinc oxide, waterglass, aluminum foil, graphite, acetone, deionized water and argon; with gram (g), milliliter (mL) and cubic centimeter ($cm^3$) as unit of measurement, the chemical materials have the following usage amount:

3800 g±1 g of aluminum alloy which is $ZAlSi_7Mg$ and a solid bulk, 50 g±1 g of aluminum-copper-iron quasicrystal which is $Al_{63}Cu_{25}Fe_{12}$ and solid particles, 50 g±1 g of silicon carbide which is SiC and solid particles, 100 g±1 g of zinc oxide which is ZnO and solid powders, 25 g±1 g of waterglass which is $Na_2SiO_3.9H_2O$ and solid powders, aluminum foil with the size of 2000 mm×0.5 mm×2000 mm which is Al and a paper-like solid, graphite with the size of Φ200 mm×400 mm which is C and a solid bulk, 800 mL±10 mL of acetone which is $C_3H_6O$ and liquid, 1000 mL±50 mL of deionized water which is $H_2O$ and liquid, and 100000 $cm^3$±100 $cm^3$ of argon which is Ar and gas.

The method has the following steps of:

(1) preparing a casting mould, consisting of:

making a cylindrical casting mould of which the cavity has the size of Φ100 mm×200 mm and has surface roughness of Ra0.08-0.16 μm, using graphite materials;

(2) preparing a coating agent, consisting of:

weighing out 100 g±1 g of zinc oxide and 25 g±1 g of waterglass, and measuring out 600 mL±5 mL of deionized water; and adding 100 g±1 g of zinc oxide, 25 g±1 g of waterglass and 600 mL±5 mL of deionized water into a slurry mixer and stirring at 50 r/min for 100 min;

obtaining milk-white suspending liquid being called as the coating agent after stirring;

(3) pretreating aluminum-copper-iron quasicrystal and silicon carbide, consisting of:

① ball-milling, including: weighing out 50 g±1 g of aluminum-copper-iron quasicrystal and 50 g+1 g of silicon carbide, placing 50 g±1 g of aluminum-copper-iron quasicrystal and 50 g±1 g of silicon carbide into a jar of a ball mill, and mixing and ball-milling for 5 hours, thereby obtaining mixed fine powders after ball-milling;

② dispersing and washing by ultrasonic wave, including: placing the mixed fine powders obtained after ball-milling into a beaker, adding 400 mL of acetone and then mixing; and placing the beaker in an ultrasonic dispersion instrument, and dispersing and washing by ultrasonic wave for 100 min at the frequency of 28 kHz, thereby obtaining a mixed liquid;

③ filtrating, including: placing the mixed liquid into a Buchner funnel of a suction flask, filtrating using a millipore membrane, keeping a filter cake and removing washing liquid; and ④ vacuum drying, including: placing the filter cake into a quartz container, and then placing the quartz container in a vacuum drying oven and drying at the temperature of 200□ for 60 min under the vacuum degree of 8 Pa, thereby obtaining aluminum-copper-iron quasicrystal and silicon carbide mixed fine powders after drying;

(4) pretreating aluminum alloy, consisting of:

① cutting the aluminum alloy bulk into small pieces of which the size is less than 50 mm×50 mm×50 mm using a machine, ② coating the aluminum alloy pieces obtained after cutting using aluminum foils, and ③ preheating, including: placing the coated aluminum alloy pieces into a heating furnace and preheating at the temperature of 200□ for 60 min;

(5) smelting to obtain the aluminum-copper-iron quasicrystal and silicon carbide mixed reinforced aluminum matrix composite, which is performed in a intermediate-frequency induction melting furnace through the process of intermediate-frequency induction heating, vacuumizing, bottom blowing argon, and casting molding, consisting of:

① pretreating the cylindrical graphite mould, including:

washing the cavity of the cylindrical graphite mould using acetone to be clean, uniformly applying the prepared coating agent to the surface of the cavity of the cylindrical graphite mould, and making the coating layer have the thickness of 1 mm, and placing the cylindrical graphite mould in a drying oven and preheating at the temperature of 200□;

② opening the intermediate-frequency induction melting furnace, cleaning an inside of a graphite melting crucible, and washing using acetone to clean the inside of the crucible;

③ placing 3800 g±1 g of the aluminum alloy pieces coated by the aluminum foils at the bottom of the crucible, and placing 50 g±1 g of aluminum-copper-iron quasicrystal and 50 g±1 g of silicon carbide on the aluminum alloy pieces;

④ closing and sealing the intermediate-frequency induction melting furnace, including:

opening a vacuum pump, removing the air from the furnace to make pressure in the furnace be less than 10 Pa, and opening a heater of the intermediate-frequency induction melting furnace and heating at the temperature of 600□±5□;

⑤ passing a bottom blowing argon tube through the bottom of the graphite crucible, transmitting argon to the inside of the crucible at the speed of 1000 $C^3$/min, so as to keep the pressure in the furnace to be 0.045 Mpa, and controlling the pressure in the furnace by a gas outlet tube valve; and continuously heating, and smelting at the temperature of 720□±5□ and keeping the constant temperature of 720□±5□ for 20 min;

⑥ casting, including:

closing the bottom blowing argon tube and removing slag on the surface of melt in the crucible, and aligning a gate of the preheated cylindrical mould, and casting until filled;

⑦ cooling the mould with alloy melt to 25□ in the air; and

⑧ opening the mould after cooling, thereby obtaining the aluminum-copper-iron quasicrystal and silicon carbide mixed reinforced aluminum matrix composite;

(6) heat-treating casting, consisting of:

placing the casting in a vacuum heat treatment furnace, and heat-treating at the temperature of 535□±5□ under vacuum degree of 8 Pa for 8 h to complete solid solution;

(7) quickly placing the casting in a mesothermal cooling water tank after heat-treating and quenching using water with 65□ for 45 s;

(8) placing the casting in a heat treatment furnace after quenching and performing aging-treatment at the temperature of 180□±5□ for 6 h;

(9) washing the surface of the casting with acetone to make each surface be clean; and

(10) detecting, analyzing and representing color, microstructure and mechanical property of the aluminum-copper-iron quasicrystal and silicon carbide mixed reinforced aluminum matrix composite, consisting of:

performing XRD analysis by X-ray diffractometer;

performing analysis of tensile strength by a microcomputer control electron universal testing machine;

performing hardness analysis by a Brinell Hardness tester; and making a conclusion which is that the aluminum-copper-iron quasicrystal and silicon carbide mixed reinforced aluminum matrix composite is bulk, hardness of the aluminum-copper-iron quasicrystal and silicon carbide mixed reinforced aluminum matrix composite reaches 80.3 HB and is improved by 50.64%, tensile strength of the aluminum-copper-iron quasicrystal and silicon carbide mixed reinforced aluminum matrix composite reaches 285 Mpa and is improved by 60.42%, and corrosion resistance of the aluminum-copper-iron quasicrystal and silicon carbide mixed reinforced aluminum matrix composite is improved by 40%.

Beneficial Effects

In comparison with background art, the present invention has obvious advancement. For the case of low hardness and low tensile strength of aluminum matrix composites, in the present application, an aluminum matrix composite reinforced with the mixture of aluminum-copper-iron quasicrystal and silicon carbide is prepared with an aluminum alloy as a matrix and with aluminum-copper-iron quasicrystal and silicon carbide as reinforcement agents via smelting in a vacuum melting furnace, protection of bottom blowing argon, casting and vacuum heat-treatment. The preparing method has advanced technology, strict process, and accurate and detailed data. The prepared aluminum-copper-iron quasicrystal and silicon carbide mixed reinforced aluminum matrix composite has hardness of 80.3 HB which is improved by 50.64% and tensile strength of 285 Mpa which is improved by 60.42%, and corrosion resistance thereof is improved by 40%. The method is a perfect method for preparing an aluminum-copper-iron quasicrystal and silicon carbide mixed reinforced aluminum matrix composite.

DETAILED DESCRIPTION OF THE EMBODIMENTS

Figure 1:
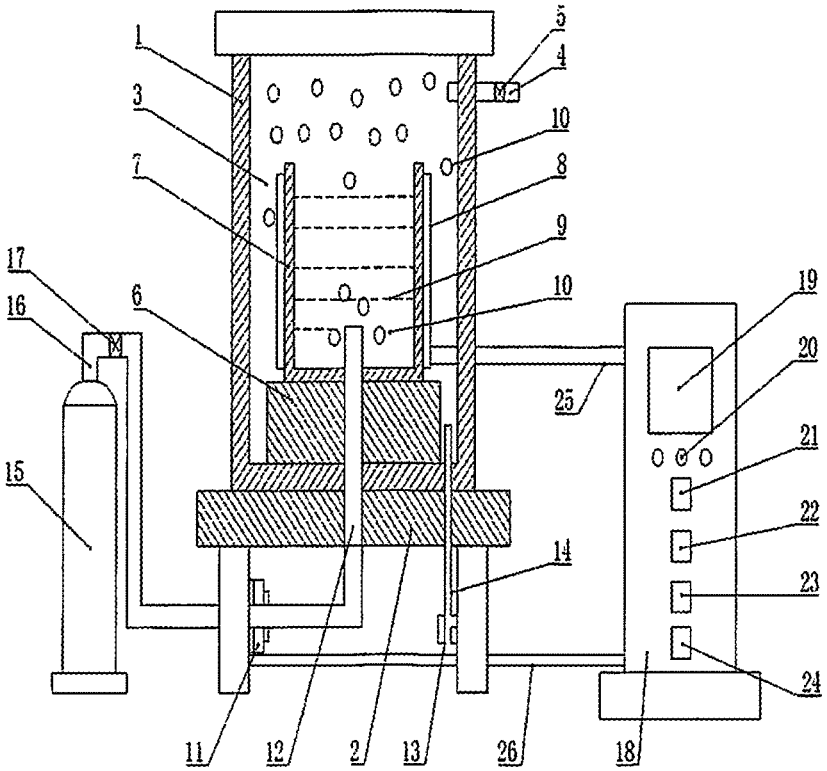
FIG. 1 is a view in smelting state of the aluminum-copper-iron quasicrystal and silicon carbide mixed reinforced aluminum matrix composite.

As shown in the Figures, the list of reference numerals is as follows:

the intermediate-frequency induction smelting furnace is represented by 1; the furnace base is represented by 2; the furnace chamber is represented by 3; the gas outlet tube is represented by 4; the gas outlet valve is represented by 5; the working table is represented by 6; the graphite melting crucible is represented by 7; the intermediate-frequency induction heater is represented by 8; the aluminum-copper-iron quasicrystal and silicon carbide mixed reinforced aluminum matrix composite melt is represented by 9; argon is represented by 10; the bottom blowing motor is represented by 11; the bottom blowing tube is represented by 12; the vacuum pump is represented by 13; the vacuum tube is represented by 14; the argon tank is represented by 15; the argon tube is represented by 16; the argon valve is represented by 17; the electric cabinet is represented by 18; the display screen is represented by 19; the indicator light is represented by 20; the power switch is represented by 21; the intermediate-frequency heat controller is represented by 22; the bottom blowing motor controller is represented by 23; the vacuum pump controller is represented by 24; the first cable is represented by 25; the second cable is represented by 26.

In combination with the drawings, the present application is further described in detail below.

A view in smelting state of the aluminum-copper-iron quasicrystal and silicon carbide mixed reinforced aluminum matrix composite is shown in FIG. 1, each part need be correct in position, ratio is conducted according to amount, and operation is conducted according to order.

Usage amount of each of the chemical materials in preparation is determined on the basis of the range set in advance, with gram, milliliter and cubic centimeter as unit of measurement.

Smelting to obtain the aluminum-copper-iron quasicrystal and silicon carbide mixed reinforced aluminum matrix composite is performed in an intermediate-frequency induction melting furnace through the process of intermediate-frequency induction heating, vacuumizing, bottom blowing argon, and casting molding.

The intermediate-frequency induction melting furnace is vertical, of which the bottom is a furnace base 2, and of which the inside is a furnace chamber 3; a working table 6 is provided at the bottom of the furnace chamber 3, a graphite melting crucible 7 is placed on the working table 6, an intermediate-frequency induction heater 8 is provided around the outside of the graphite melting crucible 7, the aluminum-copper-iron quasicrystal and silicon carbide mixed reinforced aluminum matrix composite melt 9 is placed in the graphite melting crucible 7; a gas outlet tube 4 is provided at the upper right side of the intermediate-frequency induction melting furnace 1 and is controlled by an gas outlet valve 5; an argon tank 15 which is provided with an argon tube 16 and an argon valve 17 is provided at the left side of the intermediate-frequency induction melting furnace 1; the argon tube 16 connects a bottom blowing motor 11 which connects a bottom blowing tube 12; the bottom blowing tube 12 passes through the furnace base 2 and the working table 6 and enters into the graphite melting crucible 7, so as to achieve bottom blowing smelting for the aluminum-copper-iron quasicrystal and silicon carbide mixed reinforced aluminum matrix composite melt 9; a vacuum pump 13 is provided at a lower right side of the furnace base 2 and is communicated with the furnace chamber 3 through a vacuum tube 14; an electric cabinet 18 is provided at a right side of the intermediate-frequency induction smelting furnace 1; a display screen 19, an indicator light 20, a power switch 21, an intermediate-frequency heat controller 22, a bottom blowing motor controller 23 and a vacuum pump controller 24 are provided on the electric cabinet 18; the electric cabinet 18 connects the intermediate-frequency induction heater 8 through a first cable 25 and connects the bottom blowing motor 11 and the vacuum pump 13 through a second cable 26; and argon 10 is filled in the furnace chamber 3 in which the pressure is controlled by the gas outlet tube 4 and the gas outlet valve 5.

Figure 2:
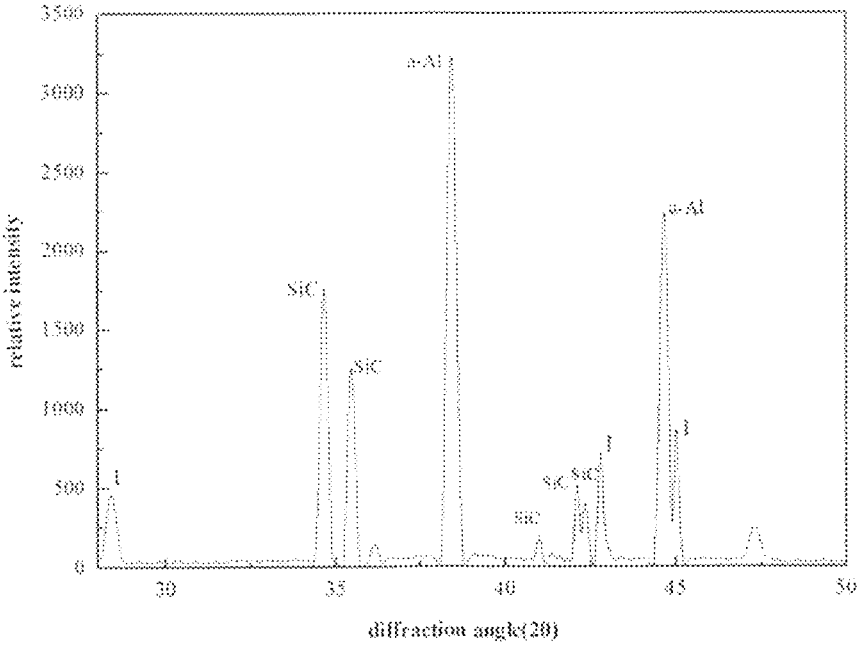
FIG. 2 is a diffraction intensity pattern of the aluminum-copper-iron quasicrystal and silicon carbide mixed reinforced aluminum matrix composite.

A diffraction intensity pattern of the aluminum-copper-iron quasicrystal and silicon carbide mixed reinforced aluminum matrix composite is shown in FIG. 2. Major peak shown in FIG. 2 is α-Al matrix, secondary peak shown in FIG. 2 is silicon carbide and aluminum-copper-iron quasicrystal I phase.

Figure 3:
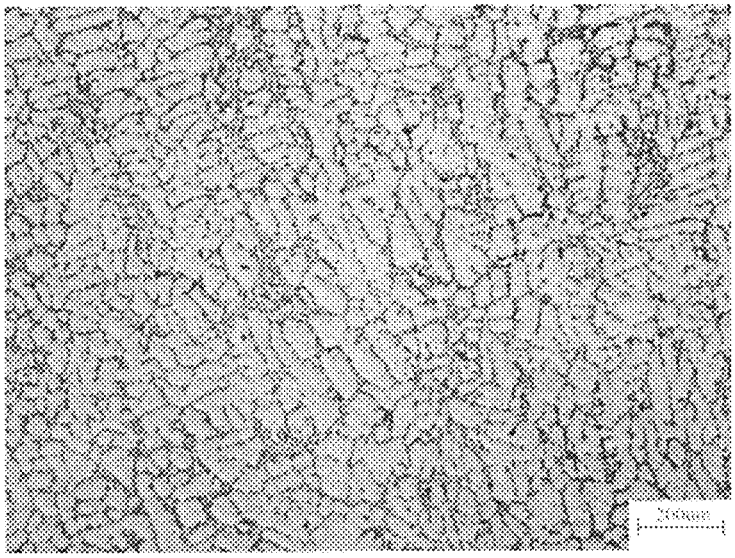
FIG. 3 is a metallographic structure micrograph of the aluminum-copper-iron quasicrystal and silicon carbide mixed reinforced aluminum matrix composite.

A metallographic structure micrograph of the aluminum-copper-iron quasicrystal and silicon carbide mixed reinforced aluminum matrix composite is shown in FIG. 3. As shown in FIG. 3, the aluminum-copper-iron quasicrystal and the silicon carbide powders are in compact combination with α-Al matrix grain boundary, so that there are non-apparent aggregation phenomenon and less porosity defect after adding aluminum-copper-iron quasicrystal and silicon carbide powders.

The invention claimed is:

1. A method of preparing an aluminum-copper-iron quasicrystal and silicon carbide mixed reinforced aluminum matrix composite, comprising chemical materials, with gram, milliliter and cubic centimeter as a unit of measurement, including 3800 g±1 g of aluminum alloy which is $ZAlSi_7Mg$ and a solid bulk, 50 g±1 g of aluminum-copper-iron quasicrystal which is $Al_{63}Cu_{25}Fe_{12}$ and solid particles, 50 g±1 g of silicon carbide which is SiC and solid particles, 100 g±1 g of zinc oxide which is ZnO and solid powders, 25 g±1 g of waterglass which is $Na_2SiO_3 \cdot 9H_2O$ and solid powders, aluminum foil with the size of 2000 mm×0.5 mm×2000 mm which is Al and a solid, graphite with the size of Ø200 mm×400 mm which is C and a solid bulk, 800 mL±10 mL of acetone which is $C_3H_6O$ and liquid, 1000 mL±50 mL of deionized water which is $H_2O$ and liquid, and 100000 $cm^3$±100 $cm^3$ of argon which is Ar and gas, the method comprising:

preparing a casting mould, including making a cylindrical casting mould with a cavity having a size of Ø100 mm×200 mm and a surface roughness of Ra0.08-0.16 μm, using graphite materials;

preparing a coating agent including weighing out 100 g±1 g of zinc oxide and 25 g±1 g of waterglass, measuring out 600 mL+5 mL of deionized water, and adding 100 g±1 g of zinc oxide, 25 g±1 g of waterglass and 600 mL±5 mL of deionized water into a slurry mixer and stirring at 50 r/min for 100 min, thereby obtaining a suspending liquid as the coating agent after stirring;

pretreating aluminum-copper-iron quasicrystal and silicon carbide, including ball-milling, including weighing out 50 g±1 g of aluminum-copper-iron quasicrystal and 50 g±1 g of silicon carbide, placing 50 g±1 g of aluminum-copper-iron quasicrystal and 50 g±1 g of silicon carbide into a jar of a ball mill, and mixing and ball-milling for 5 hours, thereby obtaining mixed fine powders after ball-milling, dispersing and washing by ultrasonic wave including placing the mixed fine powders obtained after ball-milling into a beaker, adding 400 mL of acetone and mixing, and placing the beaker in an ultrasonic dispersion instrument, and dispersing and washing by ultrasonic wave for 100 min at the frequency of 28 kHz, and obtaining a mixed liquid, filtrating, including placing the mixed liquid into a Buchner funnel of a suction flask, filtrating using a millipore membrane, keeping a filter cake and removing washing liquid, and vacuum drying, including placing the filter cake into a quartz container, and placing the quartz container in a vacuum drying oven and drying at the temperature of 200° C. for 60 min under the vacuum degree of 8 Pa, thereby obtaining aluminum-copper-iron quasicrystal and silicon carbide mixed fine powders after drying;

pretreating aluminum alloy, including cutting the aluminum alloy bulk into small pieces of which the size is less than 50 mm×50 mm×50 mm using a machine, coating the aluminum alloy pieces obtained after cutting using aluminum foils, and preheating, including placing the coated aluminum alloy pieces into a heating furnace and preheating at the temperature of 200° C. for 60 min;

smelting to obtain the aluminum-copper-iron quasicrystal and silicon carbide mixed reinforced aluminum matrix composite, which is performed in an intermediate-frequency induction melting furnace through the process of intermediate-frequency induction heating, vacuumizing, bottom blowing argon, and casting molding, including pretreating the cylindrical graphite mould, including washing the cavity of the cylindrical graphite mould using acetone to be clean, uniformly applying the prepared coating agent to the surface of the cavity of the cylindrical graphite mould, and making the coating layer have the thickness of 1 mm, and placing the cylindrical graphite mould in a drying oven and preheating at the temperature of 200° C., opening the intermediate-frequency induction melting furnace, cleaning an inside of a graphite melting crucible, and washing using acetone to clean the inside of the crucible, placing 3800 g±1 g of the aluminum alloy pieces coated by the aluminum foils at the bottom of the crucible, and placing 50 g±1 g of aluminum-copper-iron quasicrystal and 50 g±1 g of silicon carbide on the aluminum alloy pieces, closing and sealing the intermediate-frequency induction melting furnace, including opening a vacuum pump, removing the air from the furnace to make pressure in the furnace be less than 10 Pa, and opening a heater of the intermediate-frequency induction melting furnace and heating at the temperature of 600° C.±5° C., passing a bottom blowing argon tube through the bottom of the graphite crucible, transmitting argon to the inside of the crucible at the speed of 1000 $cm^3$/min, so as to keep the pressure in the furnace to be 0.045 Mpa, and controlling the pressure in the furnace by a gas outlet tube valve; and continuously heating, and smelting at the temperature of 720° C.±5° C. for 20 min, so as to obtain an aluminum-copper-iron quasicrystal and silicon carbide mixed reinforced aluminum matrix composite melt, casting, including closing the bottom blowing argon tube and removing slag on the surface of melt in the crucible, and aligning a gate of the preheated cylindrical mould, and casting until filled, cooling the mould with alloy melt to 25° C. in the air, and opening the mould after cooling, thereby obtaining the aluminum-copper-iron quasicrystal and silicon carbide mixed reinforced aluminum matrix composite;

heat-treating casting, including placing the casting in a vacuum heat treatment furnace, and heat-treating at the temperature of 535° C.±5° C. under vacuum degree of 8 Pa for 8 h to complete solid solution;

placing the casting in a mesothermal cooling water tank after heat-treating and quenching using water of 65° C. for 45 s;

placing the casting in a heat treatment furnace after quenching and performing aging-treatment at the temperature of 180° C.±5° C. for 6 h; and washing the surface of the casting with acetone to clean each surface.

2. The method for preparing the aluminum-copper-iron quasicrystal and silicon carbide mixed reinforced aluminum matrix composite according to claim 1, wherein the smelting to obtain the aluminum-copper-iron quasicrystal and silicon carbide mixed reinforced aluminum matrix composite is performed in the intermediate-frequency induction melting furnace through the process of intermediate-frequency induction heating, vacuumizing, bottom blowing argon, and casting molding;

the intermediate-frequency induction melting furnace is vertical, of which the bottom is a furnace base, and of which the inside is a furnace chamber, a working table is provided at the bottom of the furnace chamber, a graphite melting crucible is placed on the working table, an intermediate-frequency induction heater is provided around the outside of the graphite melting crucible, the aluminum-copper-iron quasicrystal and silicon carbide mixed reinforced aluminum matrix composite melt is placed in the graphite melting crucible, a gas outlet tube is provided at the upper right side of the intermediate-frequency induction melting furnace and is controlled by a gas outlet valve, an argon tank which is provided with an argon tube and an argon valve is provided at the left side of the intermediate-frequency induction melting furnace, the argon tube connects a bottom blowing motor which connects a bottom blowing tube, the bottom blowing tube passes through the furnace base and the working table and enters into the graphite melting crucible, so as to achieve bottom blowing smelting for the aluminum-copper-iron quasicrystal and silicon carbide mixed reinforced aluminum matrix composite melt, a vacuum pump is provided at a lower right side of the furnace base and communicates with the furnace chamber through a vacuum tube, an electric cabinet is provided at a right side of the intermediate-frequency induction smelting furnace, a display screen, an indicator light, a power switch, an intermediate-frequency heat controller, a bottom blowing motor controller and a vacuum pump controller are provided on the electric cabinet, the electric cabinet connects the intermediate-frequency induction heater through a first cable and connects the bottom blowing motor and the vacuum pump through a second cable, and argon is filled in the furnace chamber in which the pressure is controlled by the gas outlet tube and the gas outlet valve.

3. The method for preparing the aluminum-copper-iron quasicrystal and silicon carbide mixed reinforced aluminum matrix composite according to claim 1, further comprising:

detecting, analyzing and representing color, microstructure and mechanical property of the aluminum-copper-iron quasicrystal and silicon carbide mixed reinforced aluminum matrix composite, including performing XRD analysis by X-ray diffractometer, performing analysis of tensile strength by a microcomputer control electron universal testing machine, performing hardness analysis by a Brinell hardness tester, and determining whether the aluminum-copper-iron quasicrystal and silicon carbide mixed reinforced aluminum matrix composite is bulk, the hardness of the aluminum-copper-iron quasicrystal and silicon carbide mixed reinforced aluminum matrix composite reaches 80.3 HB, and the tensile strength of the aluminum-copper-iron quasicrystal and silicon carbide mixed reinforced aluminum matrix composite reaches 285 Mpa.

* * * * *